US007871501B2

(12) United States Patent
Gondal et al.

(10) Patent No.: US 7,871,501 B2
(45) Date of Patent: Jan. 18, 2011

(54) LASER-BASED METHOD FOR REMOVAL OF SULFUR (DMDBT) IN HYDROCARBON FUELS

(75) Inventors: Muhammed A. Gondal, Islamabad (PK); Josef Pola, Prague (CZ); Zain H. Yamani, Dhahran (SA); Husain M. Masoudi, Dhahran (SA); Abdul R. A. Al-Arfaj, Dhahran (SA)

(73) Assignee: King Fahd University of Petroleum and Minerals (SA)

( * ) Notice: Subject to any disclaimer, the term of this patent is extended or adjusted under 35 U.S.C. 154(b) by 1099 days.

(21) Appl. No.: 11/599,456

(22) Filed: Nov. 15, 2006

(65) Prior Publication Data

US 2008/0110802 A1 May 15, 2008

(51) Int. Cl.
*C10G 45/02* (2006.01)

(52) U.S. Cl. ..... 204/157.61; 204/157.15; 204/157.63; 204/157.64; 208/208 R

(58) Field of Classification Search ..... 208/208 R; 204/157.15, 157.61, 167.63, 157.64
See application file for complete search history.

(56) References Cited

U.S. PATENT DOCUMENTS

| | | | |
|---|---|---|---|
| 1,897,617 | A | 2/1933 | Mekler |
| 2,763,593 | A | 9/1956 | Leesemann |
| 3,055,818 | A | 9/1962 | McArthur et al. |
| 3,616,375 | A | 10/1971 | Inoue |
| 3,960,683 | A | 6/1976 | Baba |
| 3,976,551 | A | 8/1976 | Warner |
| 6,824,746 | B2 | 11/2004 | Ayukawa et al. |
| 2003/0019794 | A1 | 1/2003 | Schmidt et al. |

FOREIGN PATENT DOCUMENTS

| | | | |
|---|---|---|---|
| JP | 2001-192673 | | 7/2001 |
| SU | 1668288 | * | 3/1989 |

OTHER PUBLICATIONS

Shiraishi, Y. et al. (1998). Ind. Eng. Chem. Res., 37, 203-211.*
Shiraishi et al., "Photochemical Desulfurization of Light Oils Using Oil/Hydrogen Peroxide Aqueous Solution Extraction System:Application for High Sulfur Content Straight-Run Light Gas Oil and Aromatic Rich Light Cycle Oil," J. Chem. Eng. of Japan, 1999, vol. 32, No. 1, pp. 158-161.
Shiraishi et al., "Visible Light-Induced Deep Desulfurization Process for Light Oils by Photochemical Electron-Transfer Oxidation in an Organic Two-Phase Extraction System," Ind. Eng. Chem. Res., 1999, vol. 38, pp. 3310-3318.

(Continued)

*Primary Examiner*—Robert J Hill, Jr.
*Assistant Examiner*—Brian McCaig
(74) *Attorney, Agent, or Firm*—Richard C. Litman

(57) ABSTRACT

The laser-based method for removal of sulfur (DMDBT) in hydrocarbon fuels provides for deep desulfurization of hydrogen fuels through the elimination of dimethyldibenzothiophene (DMDBT) from hydrocarbon fuels. The method involves photoexciting atomic or molecular oxygen to a singlet or triplet energy state, mixing the photoexcited oxygen with the hydrocarbon fuel, and irradiating the hydrocarbon fuel with UV radiation from a tunable laser source at a wavelength corresponding to an absorption band of dimethyldibenzothiophene. The hydrocarbon fuel may be in a liquid or an aerosol state. The oxygen may be provided by pure oxygen gas, by $N_2O$, or by air, and may be diluted by an inert carrier gas, such as $N_2$. Exemplary wavelengths of the laser radiation include 193 nm, 248 nm, and 266 nm. Sulfur is eliminated from DMDBT as elemental sulfur or gaseous sulfides and sulfur oxides, which are easily separated from the hydrocarbon fuels.

10 Claims, 10 Drawing Sheets

OTHER PUBLICATIONS

Shiraishi et al., "Photochemical Desulfurization and Denitrogenation Process for Vacuum Gas Oil Using an Organic Two-Phase Extraction System," Ind. Eng. Chem. Res., 2001, vol. 40, pp. 293-303.

Babich, I.V. and Moulijn, J.A., "Science and technology of novel processes for deep desulfurization of oil refining streams:a review," Fuel, Nov. 2002, vol. 82, pp. 607-631.

* cited by examiner

LASER-BASED METHOD FOR REMOVAL OF SULFUR (DMDBT) IN HYDROCARBON FUELS

BACKGROUND OF THE INVENTION

1. Field of the Invention

The present invention relates to processes for the desulfurization of petroleum products during the refining process or otherwise before combustion, and particularly to a laser-based method for the removal of sulfur, particularly in the form of dimethyldibenzothiophene, in hydrocarbon fuels.

2. Description of the Related Art

Clean desulfurization of hydrocarbon fuels is an important issue due to environmental concerns (green house effect, acid rain, ozone depletion) and compliance with the regulations set by international agencies, controlling the environment. Sulfur content in transportation fuel (diesel) is an environmental concern because upon combustion, sulfur is converted to $SO_x$ during combustion, which not only contributes to acid rain, but also poisons the catalytic converter installed in modem automobiles for exhaust emission treatment.

Due to these concerns, drastic changes and stringent regulations were implemented in many countries concerning diesel and gasoline. Currently the fuel specifications for all highway traffic in the U.S., Japan, and Western Europe limit the sulfur content of the diesel to be less than 500 ppm. The new regulations in many countries will further lower the contents of sulfur in diesel fuels. By the year 2006, the sulfur content in diesel has to be reduced to less than 15 ppm and to less than 30 ppm in gasoline.

For this purpose, various techniques, such as hydrogenation and caustic treatment, have been developed to reduce the sulfur contents in hydrocarbon fuels. These conventional hydro-desulfurization (HDS) methods can remove a major portion of the sulfur from diesel fuels, but they are unable to remove the so-called "hard sulfur", i.e., the sulfur that is strongly bonded in a polycyclic aromatic sulfur compound. In order to meet the 15 ppm specifications for diesel in the future, hard sulfur contents, such as dimethyldibenzothiophene (DMDBT), must be removed from diesel and other feed stocks and products.

The conventional hydrodesulfurization (HDS) process for removing easy sulfurs and polycyclic aromatics has been adopted on a commercial scale. Easy sulfurs include non-thiophenic sulfur (elemental sulfur, disulfides, mercaptans, etc.), but not thiophenes, benzothiophenes, and dibenzothiophenes in which the substituents are away from the sulfur heteroatom. In the conventional HDS process, polycyclic aromatics with more than one aromatic ring are mostly reduced to polynuclear aromatics having a single aromatic ring (e.g., tetralins). Thus, there is a strong demand for removing hard sulfurs from a large number of polynuclear aromatics.

Conventional techniques have their own technical limitations and cost effectiveness (octane loss) to reduce certain sulfur compounds, such as 4,6 dimethyldibenzothiophene, which is a major obstacle to bringing down the sulfur level to <15 ppm limit.

Due to the above mentioned reasons, there is a continuing vital interest in the development of approaches to ultra-clean diesel fuels by deep desulfurization and deep dearomatization. The procedures of sulfur removal are mostly related to degradation of the most stubborn sulfur-containing contaminants, which are benzothiophenes, particularly 4,6-dimethyldibenzothiophene, and they involve catalytic desulfurization and photolytic oxidation of this family of compounds.

Recent photochemical approaches for desulfurization of hydrocarbon fuels involve photochemical oxidation of sulfur-containing hydrocarbons by conventional UV or visible radiation sources (lamps). The sulfur-containing hydrocarbons are oxidized when suspended in aqueous-soluble solvent (e.g., acetonitrile), and the oxidation products are concentrated in this solvent due to their higher polarity. The exploration of these processes by Hirai et al., *Ind. Eng. Chem. Res.*, Vol. 36, pp. 530-533 (1997) and Shiraishi et al., *Ind. Eng. Chem. Res.*, Vol. 37, pp. 203-211 (1998); Vol. 38, pp. 3310-3318 (1999); Vol. 40, pp. 293-303; and *J. Chem. Eng. of Japan*, Vol. 32, No. 1, pp. 158-161 (1999) revealed the ensuing features of these processes:

(i) The photochemical excitation of benzothiophenes is diminished in the presence of naphthalene, which is due to triplet energy transfer from the photoexcited benzothiophenes to the ground state naphthalene;

(ii) Photo-oxidation is assisted by a triplet photosensitizer (9,10-dicyanoanthracene);

(iii) The desulfurization is improved by introducing hydrogen peroxide into the contact water phase, since $H_2O_2$ acts as a weak oxidizing reagent of the photoexcited benzothiophenes and also makes the triplet energy transfer between benzothiophenes and naphthalene less efficient.

Although these photo-oxidation approaches are efficient for removing sulfur from light oils, catalytically cracked gasoline, and vacuum gas oils, their application in industry is not obvious due to problems in the separation of the solvent, the oxidized products and the sensitizer. The products of photo-oxidation of benzothiophenes in water are benzothiophene carboxylic acids, and the major mechanism of photochemical degradation of dibenzothiophene in aqueous solution is the oxidation of a benzo ring to form benzothiophene dicarboxylic acid and opening the thiophene ring, leading to sulfobenzoic acids.

A somewhat promising process for application purposes appears to be a conventional photochemical desulfurization in a hydrogen peroxide aqueous solution extraction system that is suited for high sulfur-content-straight-run light gas oil and aromatic-rich light cycle. However, this procedure is performed through the use of a high-pressure mercury lamp for direct excitation of sulfur-containing compounds, and results in a decreased sulfur content only after very prolonged (36 hours) irradiation.

These photochemical desulfurization processes reported so far are unfortunately suppressed in the presence of aromatic compounds (2-ring aromatics) and are therefore too slow with substituted dibenzothiophenes. This finding is in line with the commonly considered relative feasibility of sulfur compounds to undergo desulfurization. The reactivities decrease in the order thiophenes>benzothiophenes>dibenzothiophenes.

None of the above publications, taken either singly or in combination, is seen to describe the instant invention as claimed. Thus, a laser-based method for removal of sulfur (DMDBT) in hydrocarbon fuels solving the aforementioned problems is desired.

SUMMARY OF THE INVENTION

The laser-based method for removal of sulfur (DMDBT) in hydrocarbon fuels provides for deep desulphurization of hydrogen fuels through the elimination of dimethyldibenzothiophene (DMDBT) from hydrocarbon fuels. The method involves photoexciting atomic or molecular oxygen to a singlet or triplet energy state, mixing the photoexcited oxygen with the hydrocarbon fuel, and irradiating the hydrocarbon fuel with UV radiation from a tunable laser source at a wavelength corresponding to an absorption band of dimethyldibenzothiophene. The hydrocarbon fuel may be in a liquid or an aerosol state. The oxygen may be provided by pure oxygen gas, by $N_2O$, or by air, and may be diluted by an inert carrier gas, such as $N_2$. Exemplary wavelengths of the laser radiation include 193 nm, 248 nm, and 266 nm. Sulfur is eliminated from DMDBT as elemental sulfur or gaseous sulfides and sulfur oxides, which are easily separated from the hydrocarbon fuels.

The method is particularly effective in removing 4,6-dimethyldibenzothiophene, a compound present in hydrocarbon fuels that is resistant to conventional methods of removing sulfur from hydrocarbon fuels due to steric hindrance of the sulfur in thiophene. However, the method is also effective in removing other alkyl substituted dibenzothiophenes. The reaction is thought to proceed by oxidation of triplet dimethyldibenzothiophene by the photoexcited oxygen. The formation of triplet dimethyldibenzothiophene is enabled by the ability to tune the laser to the very narrow wavelength required to excite DMDBT without also exciting other aromatic compounds that are also present in hydrocarbon fuels. Photoexcitation of the oxygen may occur simultaneously with laser irradiation of the DMDBT, i.e., the order of the steps is not critical.

Hydrocarbon fuels desulfurized by the laser-based method of the present invention may be produced in greater yield and with less deterioration in quality than hydrocarbon fuels desulfurized by conventional methods. The hydrocarbon fuel may be gasoline, diesel fuels, kerosene, fuel oils, and any other hydrocarbon fuel that may be derived from petroleum or petroleum products. The laser-based method of the present invention may be used in combination with, or as a supplement to, conventional desulfurization processes used to remove mercaptans, disulfides, and other simpler sulfur compounds from hydrocarbon fuels.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a laser-based method for removal of sulfur, and particularly dimethyldibenzothiophene, in hydrocarbon fuels. The method was developed by studying oxidative photodegradation of 1,6-dimethyldibenzothiophene using intense laser irradiation at $150 \leqq \lambda \leqq 530$ nm. The method is based on laser irradiation of benzothiophenes in the presence of such compounds as atomic oxygen (O), molecular oxygen ($O_2$), air, and nitrous oxide ($N_2O$) that can be laser-photolysed into very reactive oxidative reagents that can react with benzothiophenes to yield photo-oxidation products that finally degrade into hydrocarbons and sulfur/sulfur oxide.

Two major research schemes were investigated. These are laser-induced photo-oxidation of dibenzothiophenes with molecular oxygen in an excited state ($^1O_2$) and laser-induced photo-oxidation of dibenzothiophenes with atomic oxygen in highly reactive states like O ($^1D$). The excited molecular state and atomic oxygen states can be generated by selective excitation of molecular oxygen and nitrous oxide using a tunable UV laser.

Figure 1:
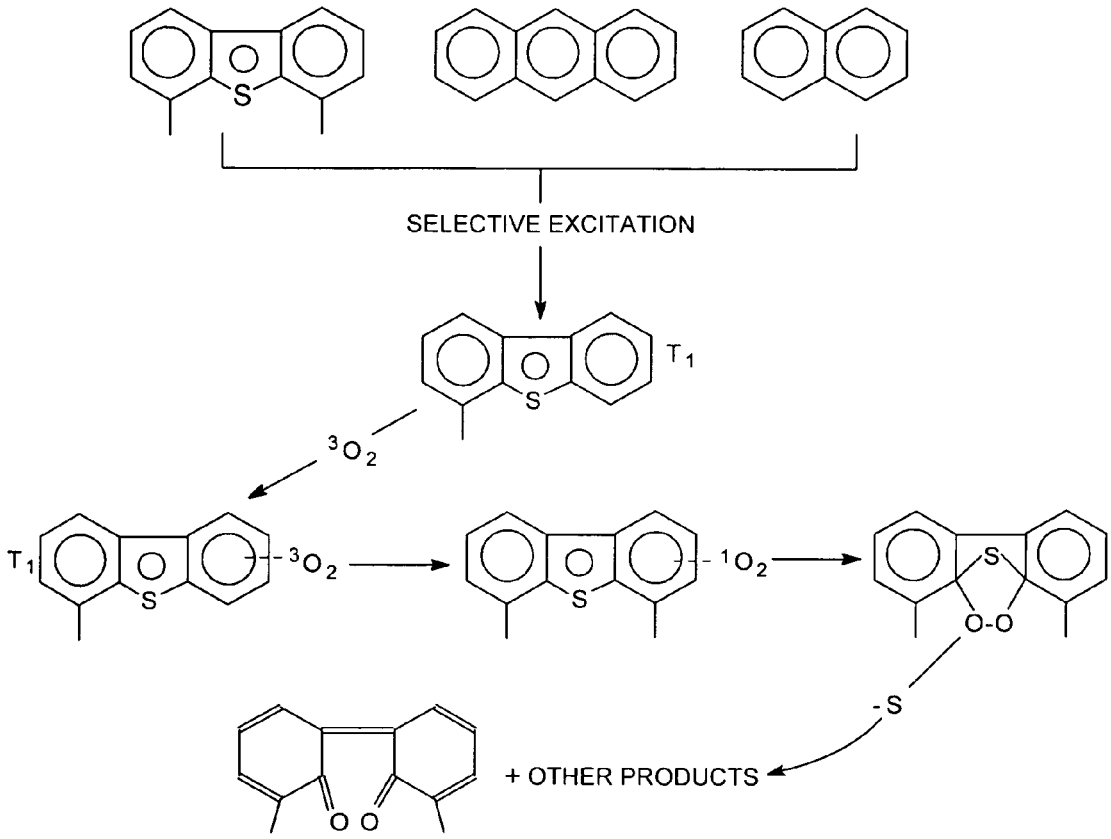
FIG. 1 is a reaction scheme for a laser-based method for removal of sulfur (DMDBT) in hydrocarbon fuels according to the present invention.

FIG. 1 shows a first reaction scheme for carrying out the laser-based method of the present invention. In this reaction scheme, molecular ($^1O_2$) is generated through interaction of triplet benzothiophene with $^3O_2$, which is simply ensured by laser excitation of benzothiophene in the presence of triplet molecular oxygen or air. The use of laser monochromatic radiation makes possible selectively exciting dibenzothiophenes, and leaves most other aromatic hydrocarbons not activated for reaction with $^3O_2$ due to tuning the laser wavelength to specific absorption bands of dibenzothiophenes.

Figure 2:
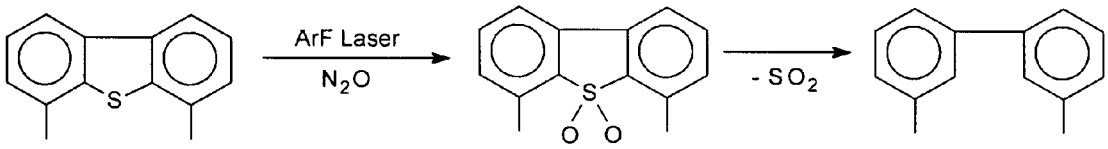
FIG. 2 is an alternative reaction scheme for a laser-based method for removal of sulfur (DMDBT) in hydrocarbon fuels according to the present invention.

FIG. 2 shows an alternative reaction scheme for carrying out the laser-based method of the present invention. This alternative reaction scheme is based upon (i) the photochemical decomposition of nitrous oxide into atomic oxygen and molecular nitrogen i.e., $$N_2O + h\nu \rightarrow O(^1D) + N_2$$

and on (ii) the high reactivity of O atoms towards thiophene in the gas phase (or in an aerosol system). Here the oxygen atom is generated by photo-dissociation of $N_2O$ using an ArF laser.

The rate constant for the reaction of atomic oxygen with thiophene is 300 times higher than that with benzene, but is similar to that with alkenes. The course of the reaction of oxygen with sulfur-containing organic molecules proceeds via an initial addition of oxygen to the sulfur atom. $N_2O$ is soluble in organic solvents and could be photolysed by laser radiation, and thus induce reaction of atomic oxygen with dibenzothiophenes. This reaction is faster than that with aromatic compounds and comparable to that with hydrocarbons.

It is expected that the oxygen atom reacts with hydrocarbons via addition to multiple bonds and via H-abstraction. These reactions lead to the formation of hydroxide radical that can undergo further reaction with hydrocarbons to finally produce $H_2O$, lower-molecular weight hydrocarbons, and oxygenated hydrocarbons. The hydroxide radical reaction with benzothiophene is expected to be initiated by addition to the aromatic ring.

In this alternative reaction scheme, laser oxidative cleavage could lead to aromatic compounds with S—O and $SO_2$ groups, as indicated in FIG. 2, and also further cleavage (extrusion of sulfur-containing fragments). These reactions could be accompanied with oxidation of unsaturated hydrocarbons present in hydrocarbon fuels.

The effect of the oxidizing reagent could partly consist in the laser-induced (transient) formation of hydroxide radical that can induce a chain photo-oxidation of DMDBT in the liquid phase. This reaction could occur in a specific way, so that DMDBT depletion occurs within intervals longer than the laser irradiation interval.

The laser-based method of the present invention provides for UV laser-induced degradation of 4,6dimethyldibenzothiophene either in the absence or in the presence of hydrogen peroxide and molecular oxygen. This process enables the degradation of 4,6-dimethyldibenzothiophene by tuning the laser irradiation particularly and preferentially to 4,6-dimethyldibenzothiophene absorptions bands, and thus to achieve a preferential decomposition of this compound. The principle of selective irradiation/preferential decomposition of 4,6dimethyldibenzothiophene is enabled by the different absorption spectra of fuel contaminants. The inventors completed several experiments to demonstrate the ability of the laser photolytic process to the remove 4,6-dimethyldibenzothiophene from model hydrocarbon compounds.

A special reaction chamber for the removal of DMDBT was designed and fabricated locally. The irradiation experiments for removal of DMDBT were carried out in different vessels and the following protocols were adopted.

$N_2O$ or $O_2$ or synthetic air was bubbled through the hydrocarbon solution of DMDBT using a gas dispersion tube.

A hydrocarbon solution of DMDBT was introduced to a vessel containing gases ($N_2O$, $O_2$ or air) at reduced pressures through a capillary tube.

Droplets of hydrocarbon solution of DMDBT (aerosol) were introduced into the irradiated zone of a vessel in a stream of $N_2O$ or $O_2$ diluted with inert carrier gas.

The $N_2$ concentration was considerably higher than that of $N_2O$ to prevent complications from the reaction: $O+N_2O \rightarrow 2NO$.

In detail, a special Pyrex® (Pyrex is a registered trademark of Corning, Incorporated of Corning, N.Y.) cell of 1 ml volume, equipped with optical grade quartz windows for the transmission of UV and visible laser beams, was used. The cell was equipped with some ports and rubber septums for sampling. Keeping in view the importance of the main experimental parameters and their effect on the desulfurization process, the first step was to see the laser wavelength dependence, duration of laser exposure and the laser energy for maximum removal of DMDBT in a model compound like hexane and naphthalene. The above-mentioned parameters were optimized. The tuning range studied for the optimization of the laser wavelength was $150 \leqq \lambda \leqq 530$ nm, while for optimization of laser energy, the range studied was 30-150 $mJ/cm^2$. The irradiated DMDBT solutions or aerosols were analyzed by UV absorption spectrometry, gas chromatography and mass spectrometry-gas chromatography (GC/MS) to determine the final products of the photochemical oxidative degradation. Care was taken to determine photochemical efficiency of the photo-oxidative degradation of DMDBT.

Four different kinds of lasers were employed as a tunable light source. These include 355 and 266 nm wavelength laser beams generated by the third and fourth harmonics of a Spectra Physics Nd:YAG Laser (Model GCR 250), a 193 nm laser beam generated from an ArF Excimer Laser (Lambda Phys Model EMG 201), and a 248 nm laser beam generated from a KrF excimer Laser (Lambda Phys Model EMG 201). The pulse width of these lasers was in the 8-20 nano second range with a 10 Hz repetition rate. The laser beam was directed into the center of the reaction chamber using a set of mirrors. For all the measurements, the laser beam diameter was kept constant. This precaution was taken to ensure the exposure of the same volume of the hydrocarbon fuels, and to study the parametric dependence under the same photon intensity.

Specific experiments were performed to study the removal of sulfur containing compound DMDBT, which are described below as different examples.

EXAMPLE 1

DMDBT Removal as a Function of Laser Irradiation Time Using ArF Laser

Figure 3:
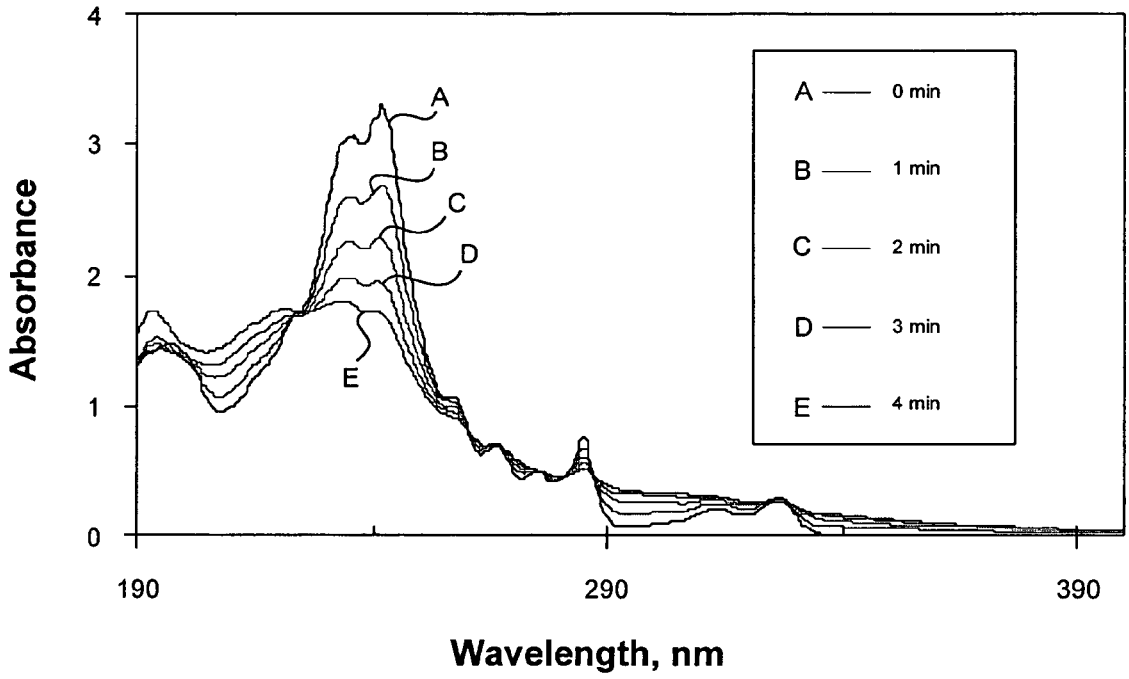
FIG. 3 are absorption spectra showing the extent of desulfurization as a function of time with irradiation from an ArF laser in a laser-based method for removal of sulfur (DMDBT) in hydrocarbon fuels according to the present invention.

Laser irradiation (at 193 nm having incident pulse energy of 34 mJ and repetition rate of 10 Hz) of a $10^{-4}$M solution of 4,6-dimethyldibenzothiophene in c-hexane (cyclohexane) in a standard UV spectral grade cell (1 ml in volume) for 4 minutes resulted in an almost complete degradation of 4,6-dimethyldibenzothiophene, as shown by FIG. 3, and yields, as identified by mass spectral analysis, volatile gaseous hydrocarbons (ethyne, ethane, propene) and aromatic hydrocarbons, along with elemental sulfur.

EXAMPLE 2

DMDBT Removal in Different Solvents Using ArF Laser (193 nm)

Figure 4:
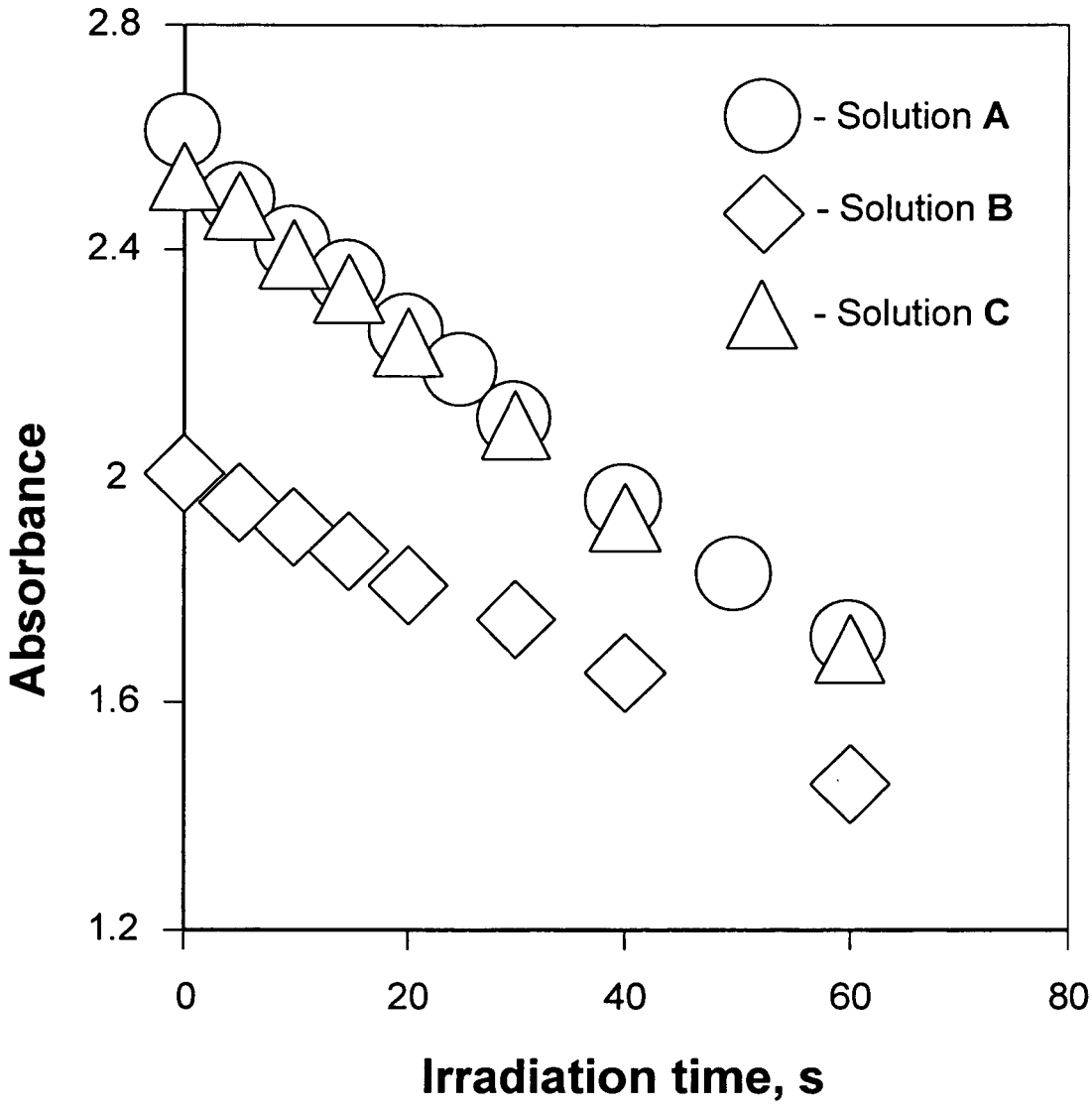
FIG. 4 is a chart showing the extent of desulfurization as a function of time with irradiation at 241 nm in a laser-based method for removal of sulfur (DMDBT) in hydrocarbon fuels according to the present invention.

Laser irradiation (193 nm, incident pulse energy 70 mJ, 10 Hz) of the $6\times10^{-5}$M and $8\times10^{-5}$M solutions of 4,6-dimethyldibenzothiophene in c-hexane, tetrahydrofuran and acetonitrile in a UV spectral cell (1.5 ml in volume) resulted in a 30-35% degradation of 4,6-dimethyldibenzothiophene within 1 minute, as shown in FIG. 4. The degradation of 4,6-dimethyldibenzothiophene in these solvents proceeds at similar rates and is not affected by the presence of hydrogen peroxide.

In FIG. 4, Solution A is 1.5 ml of an $8\times10^{-5}$M solution of DMDBT in c-hexane, Solution B is 1.5 ml of a $6\times10^{-5}$M solution of 4,6-dimethyldibenzothiophene in acetonitrile, and Solution C is 1.5 ml of an $8\times10^{-5}$M solution of 4,6-dimethyldibenzothiophene in c-hexane containing 1.5 μl of $10^{-2}$M $H_2O_2$ in water and intensely stirred during laser irradiation.

EXAMPLE 3

Degradation of 4,6-dimethyldibenzothiophene Using KrF Laser

Figure 5:
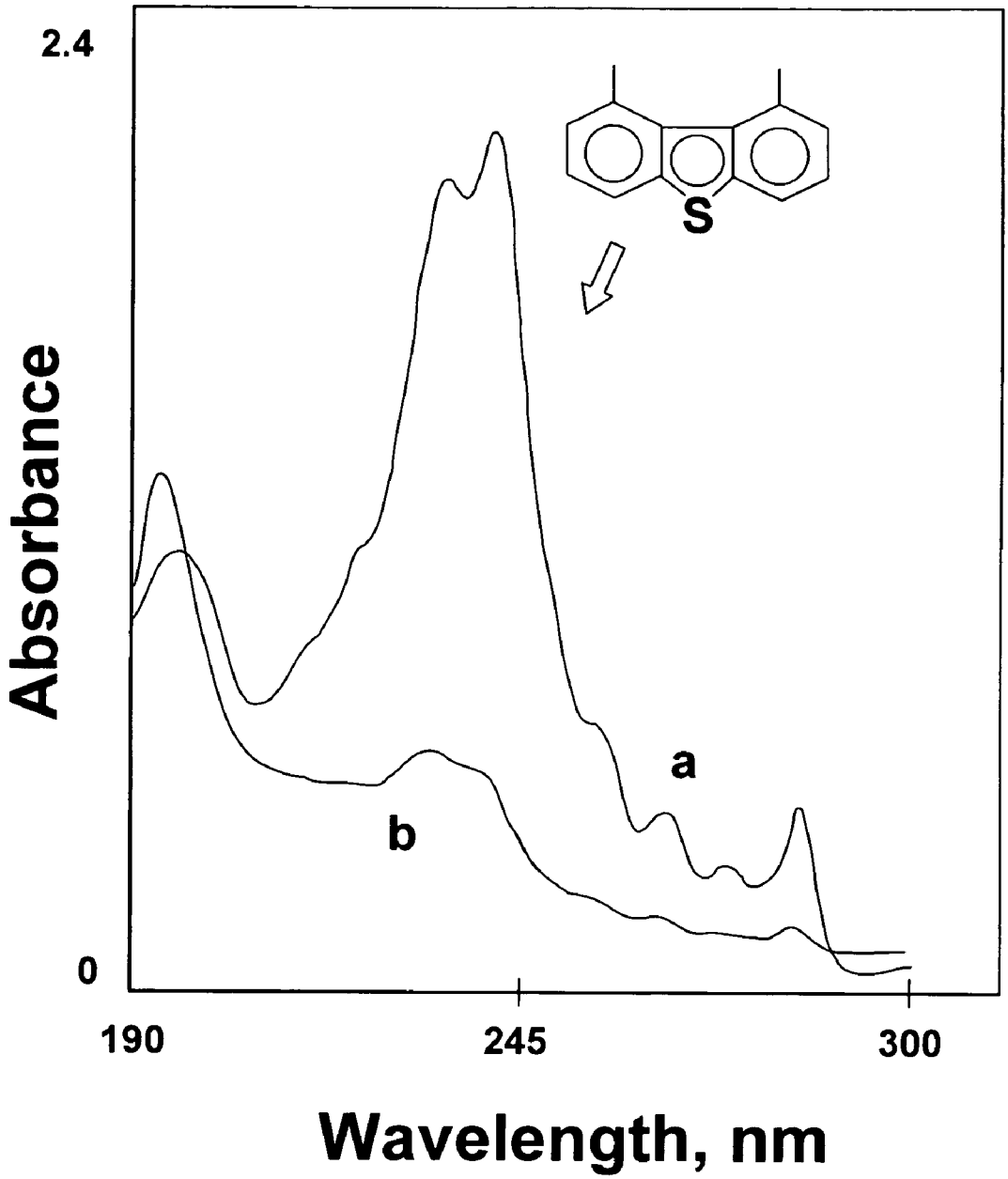
FIG. 5 are absorption spectra showing the extent of desulfurization with irradiation from a KrF laser at 248 nm in a laser-based method for removal of sulfur (DMDBT) in hydrocarbon fuels according to the present invention, the spectrum (a) showing the absorption spectrum before irradiation and the spectrum (b) showing the absorption spectrum after one minute of irradiation.

Laser irradiation (248 nm, incident pulse energy 60 m], 10 Hz) of a $5\times10^{-6}$ M solution of 4,6-dimethyldibenzothiophene in c-hexane (UV spectral grade) in a standard UV spectral cell (4 ml in volume) for 40 seconds resulted in an almost complete degradation of 4,6-dimethyldibenzothiophene, as shown in FIG. 5.

EXAMPLE 4

Effect of Laser Power on DMDBT Removal

Figure 6:
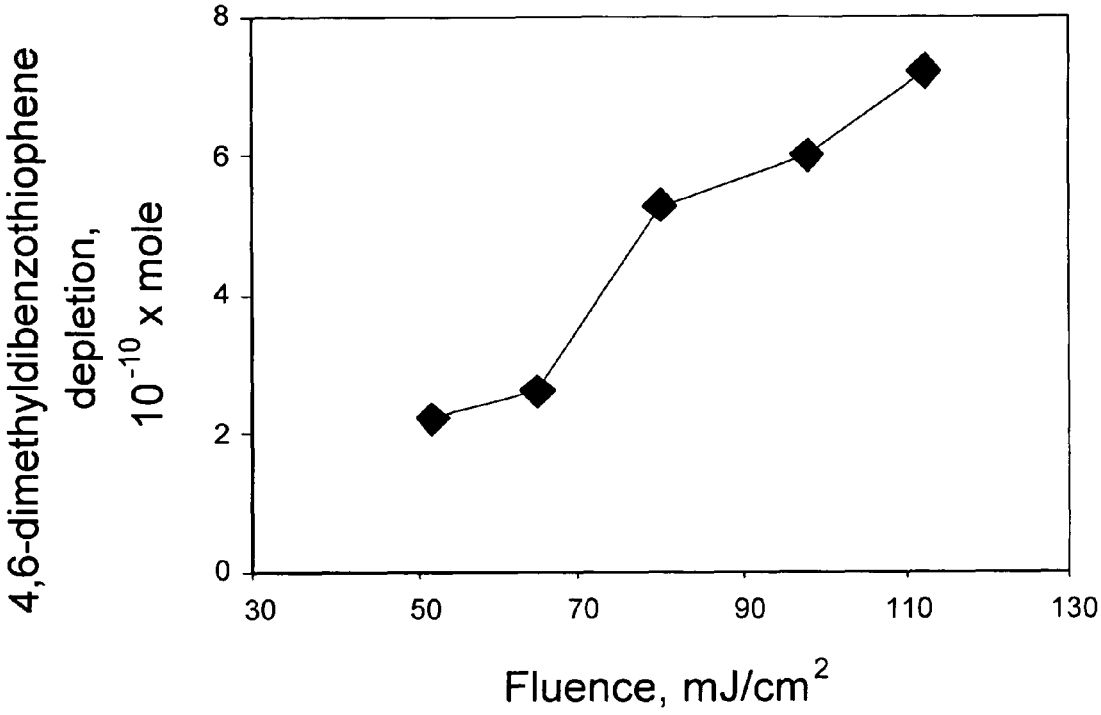
FIG. 6 is a chart showing depletion as a function of fluence in a laser-based method for removal of sulfur (DMDBT) in hydrocarbon fuels according to the present invention.

The efficiency of the KrF laser-photolytic depletion of 4,6-dimethyldibenzothiophene is linearly dependent on the incident laser fluence, as shown in FIG. 6. This implies that the degradation takes place as a 1 photon-induced process.

EXAMPLE 5

DMDBT Removal in C-Hexane and Naphthalene Model Hydrocarbons

Figure 7:
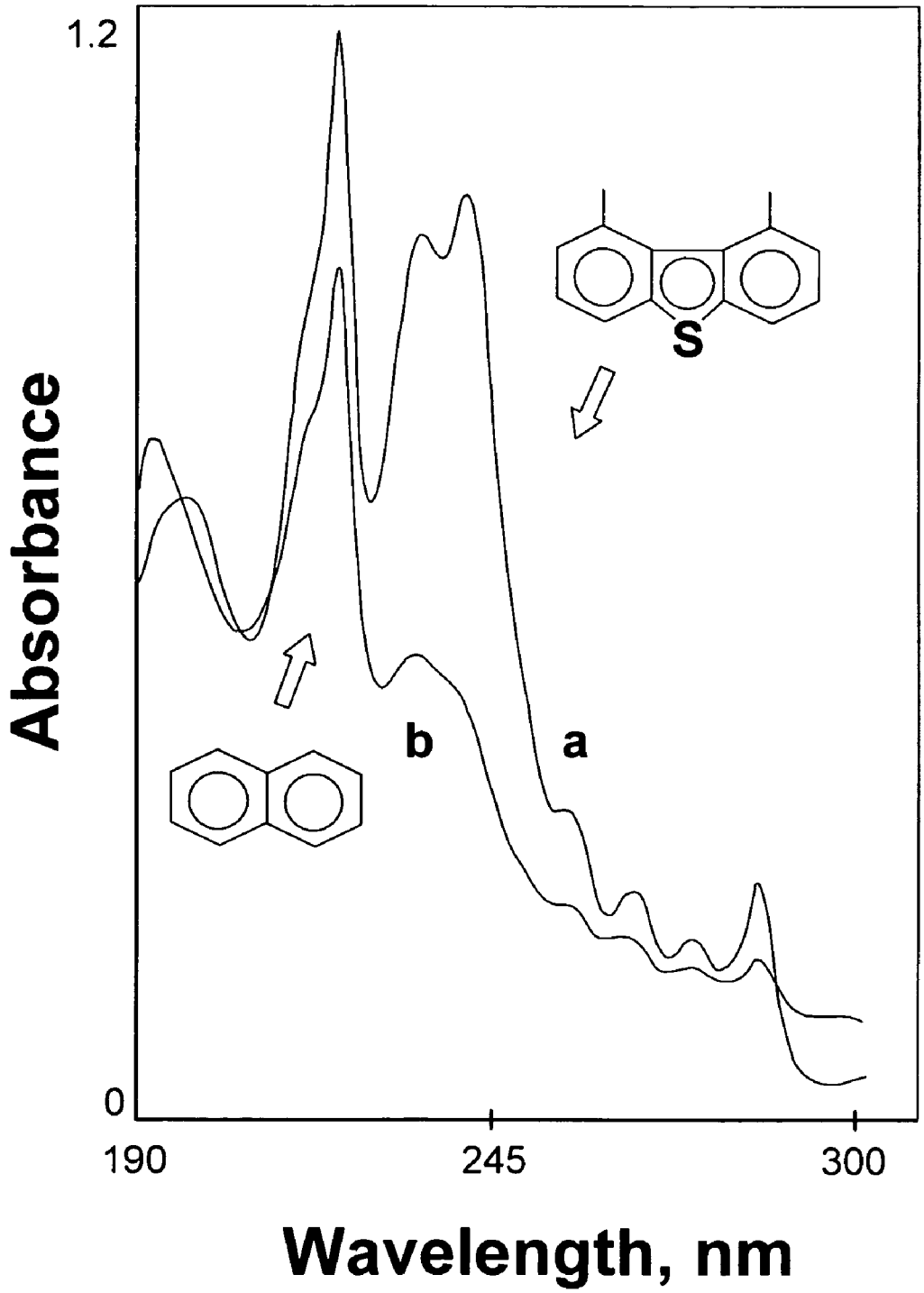
FIG. 7 are absorption spectra showing selective degradation of 4,6 DMDBT in the presence of naphthalene in a laser-based method for removal of sulfur (DMDBT) in hydrocarbon fuels according to the present invention, spectrum A showing the absorption spectrum of a mixture of DMDBT before irradiation and spectrum B showing the absorption spectrum of the mixture after 20 seconds irradiation at 248 nm.

Laser irradiation (248 nm, incident pulse energy 60 mJ, 10 Hz) of a solution obtained by mixing 2 ml of a $2.5\times10^{-6}$M solution of 4,6-dimethyldibenzothiophene in hexane and 2 ml of a $0.75\times10^{-5}$ M solution of naphthalene in hexane for 20 seconds in the 4 ml spectral cell resulted in a complete degradation of 4,6-dimethyldibenzothiophene and much slower degradation of naphthalene, as shown in FIG. 7. This example shows the effect of tuning the radiation into 4,6-dimethyldibenzothiophene absorption band and reveals that other aromatic compounds are also degraded (but less efficiently) with 248 nm radiation.

EXAMPLE 6

DMDBT Removal Monitored Using GC Analysis

Laser irradiation (248 nm, incident pulse energy 200 mJ, 10 Hz) for 15 minutes of 25 ml of $4\times10^{-3}$ M solution of 4,6-dimethyldibenzothiophene in c-hexane placed in a quartz tube opened to air atmosphere results in complete degradation of 4,6-dimethyldibenzothiophene and development of a yellow color (elemental sulfur). The major products identified by GC/MS technique were toluene, phenol, 2-methylpropylbenzene, 1-ethylbutylbenzene, 1-methyl-1-pentylbenzene, p-mentha-2,5-dien-7-ol, 1,4-dihydrophenylmethanol, n-hexylbenzene, 1,2-dimethylpropoxybenzene, n-hexylphenyl ether, diphenyl, 1-hexanol, and 2,5-hexanediol, which confirms homolytic formation of radicals, their coupling reactions and reactions with air (oxygen). The results also show that there were cleavage reactions of the solvent.

EXAMPLE 7

Nd:YAG Laser Degradation of 4,6-dimethyldibenzothiophene Under Air Atmosphere

Figure 8:
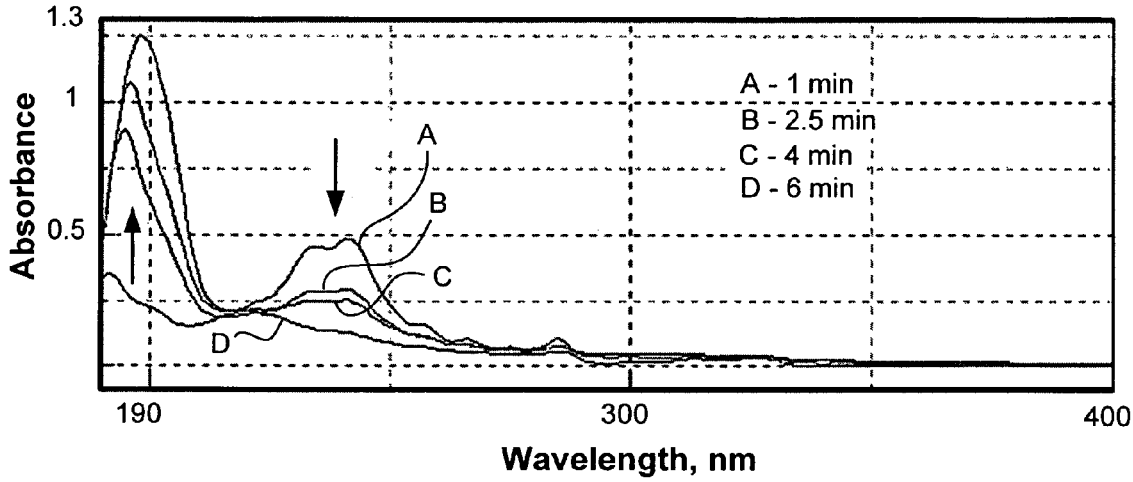
FIG. 8 is absorption spectra showing depletion as a function of pulse duration with irradiation at 266 nm in a laser-based method for removal of sulfur (DMDBT) in hydrocarbon fuels according to the present invention.

Irradiation of 4 ml of A $0.8\times10^{-6}$M solution of 4,6-dimethyldibenzothiophene in c-hexane (in spectral cell) for 6 minutes at a wavelength of 266 nm generated by the fourth harmonic of an Nd:YAG laser (Spectra Physics, Model GCR 10, incident pulse energy 40 mJ, 10 Hz) resulted in a complete depletion of 4,6-dimethyldibenzothiophene, as shown in FIG. 8. The arrows indicate the depletion of 4,6-dimethyldibenzothiophene at about 240 nm and a build-up of photolytic products at around 190 nm.

EXAMPLE 8

Figure 9:
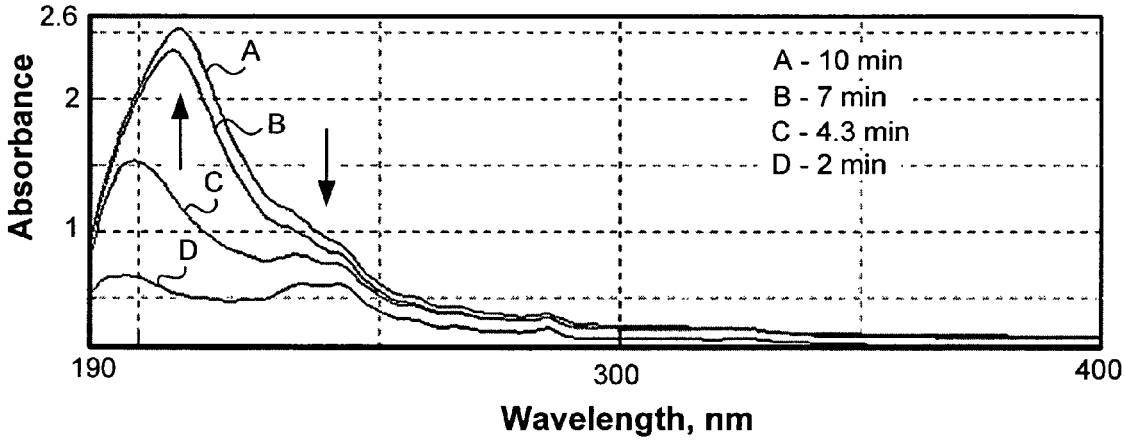
FIG. 9 are absorption spectra showing the effect of $H_2O_2$ and oxygen gas on degradation of DMDBT in a laser-based method for removal of sulfur (DMDBT) in hydrocarbon fuels according to the present invention.

Nd:YAG Laser Degradation of 4,6-dimethyldibenzothiophene Under Molecular Oxygen ($O_2$) Atmosphere A mixture of 25 ml of a $6.8\times10^{-6}$ M solution of 4,6-dimethyldibenzothiophene in c-hexane together with 25 ml of 30% $H_2O_2$ in $H_2O$ was placed in a photochemical reactor equipped with quartz window and $O_2$ was intensely bubbled through the vigorously stirred phases. Simultaneous irradiation at 266 nm (incident pulse energy 35 mJ, repetition frequency 10 Hz) for 10 minutes resulted in about 80% depletion of 4,6-dimethyldibenzothiophene, as shown in FIG. 9.

EXAMPLE 9

Nd:YAG Laser Degradation of 4,6-dimethyldibenzothiophene Under Intense Bubbling of ($O_2$)

Figure 10:
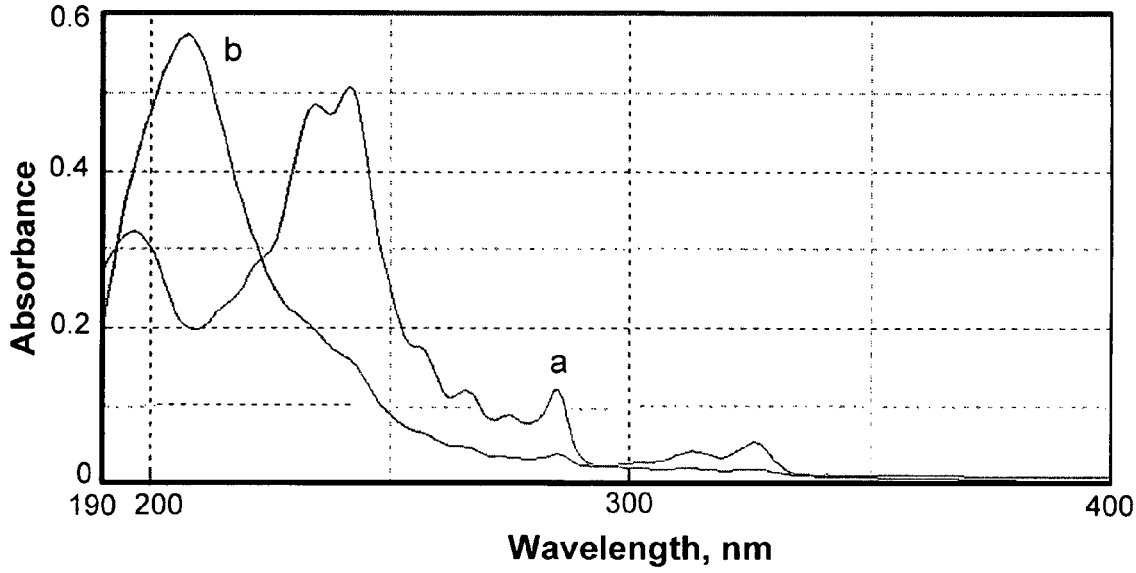
FIG. 10 are absorption spectra showing the effect of oxygen on depletion of DMDBT in a laser-based method for removal of sulfur (DMDBT) in hydrocarbon fuels according to the present invention, spectrum (a) showing the absorption spectrum before radiation and spectrum (b) showing the absorption spectrum after irradiation.

25 ml of $6.8\times10^{-6}$M solution of 4,6-dimethyldibenzothiophene in c-hexane was contained in a photochemical reactor equipped with quartz window and oxygen was intensely bubbled through the vigorously stirred solution. Simultaneous laser irradiation at 266 nm (incident pulse energy 35 mJ, repetition frequency 10 Hz) for 20 seconds resulted in a complete depletion of 4,6-dimethyldibenzothiophene, as shown in FIG. 10.

It is to be understood that the present invention is not limited to the embodiments described above, but encompasses any and all embodiments within the scope of the following claims.

We claim:

1. A laser-based method for removal of sulfur (DMDBT) in a hydrocarbon fuel, comprising the steps of:

photochemically decomposing nitrous oxide to form photoexcited oxygen and nitrogen gas;

mixing the photoexcited oxygen with the hydrocarbon fuel; and irradiating the hydrocarbon fuel with ultraviolet radiation from a tunable laser source at a wavelength corresponding to an absorption band of dimethyldibenzothiophene (DMDBT).

2. The laser-based method according to claim 1, wherein the oxygen is mixed with the hydrocarbon fuel, said photoexciting step occurring simultaneously with said irradiating step.

3. The laser-based method according to claim 1, wherein the hydrocarbon fuel is in a liquid state, said mixing step comprising bubbling pure oxygen gas into the hydrocarbon fuel.

4. The laser-based method according to claim 1, wherein the dimethyldibenzothiophene is in the gas phase.

5. The laser-based method according to claim 1, wherein the dimethyldibenzothiophene is in an aerosol.

6. The laser-based method according to claim 1, wherein said irradiating step further comprises tuning the laser source to a wavelength of 193 nm and irradiating the mixture at a wavelength of 193 nm.

7. The laser-based method according to claim 1, wherein said irradiating step further comprises tuning the laser source to a wavelength of 248 nm and irradiating the mixture at a wavelength of 248 nm.

8. The laser-based method according to claim 1, wherein said irradiating step further comprises tuning the laser source to a wavelength of 266 nm and irradiating the mixture at a wavelength of 266 nm.

9. The laser-based method according to claim 1, wherein the dimethyldibenzothiophene comprises 4,6-dimethyldibenzothiophene, said irradiating step being continued for a period of time to substantially eliminate the 4,6 -dimethyldibenzothiophene from the hydrocarbon fuel.

10. The laser-based method according to claim 1, wherein said irradiating step produces sulfides and sulfur oxides, the laser-based method further comprising the step of separating the sulfides and sulfur oxides from the hydrocarbon fuel.

* * * * *